United States Patent [19]

LaPointe

[11] Patent Number: 4,627,663

[45] Date of Patent: Dec. 9, 1986

[54] RECLINING CHAIR

[75] Inventor: Larry P. LaPointe, LaSalle, Mich.

[73] Assignee: La-Z-Boy Chair Company, Monroe, Mich.

[21] Appl. No.: 596,689

[22] Filed: Apr. 4, 1984

[51] Int. Cl.[4] ..... A47C 1/02

[52] U.S. Cl. ..... 297/316; 297/300; 297/321

[58] Field of Search ..... 297/316, 300, 301, 69, 297/83, 84, DIG. 7, 321

[56] References Cited

U.S. PATENT DOCUMENTS

| | | | |
|---|---|---|---|
| 799,128 | 9/1905 | Wilmot et al. | 297/316 X |
| 3,096,121 | 7/1963 | Knabusch et al. | 297/DIG. 7 |
| 3,608,958 | 9/1971 | Knabusch et al. | 297/69 |
| 3,947,067 | 3/1976 | Griefahn | 297/316 X |
| 4,226,473 | 10/1980 | Johnson | 297/316 |

*Primary Examiner*—Francis K. Zugel

*Attorney, Agent, or Firm*—Harness, Dickey & Pierce

[57] ABSTRACT

A chair has a seat frame that is suspended at its rear by swing links which are pivoted to the chair frame on a horizontal axis located above the level of the seat frame and a back frame which is mounted on the swing links and pivots with them about the horizontal axis to be reclined to a large angle. The front of the seat frame is supported by swing links which extend downwardly to pivot on the chair frame and define a front horizontal pivot axis for the seat frame which is located below it. Counterbalance springs are connected between them and the chair frame to provide resistance to recline of the back frame and assistance in its return to an upright position. Linkage between the end of each spring and the adjacent swing link controls extension of the spring to keep it always tight and to apply the most advantageous degree of spring force. Resistance, which can be manually adjusted to suit the chair user, is provided in the linkage system to enable the freedom of movement between recline and upright positions of the back to be regulated.

9 Claims, 4 Drawing Figures

RECLINING CHAIR

This invention relates to chairs with reclining backs. While not so limited, the invention is especially suitable for upholstered furniture used in the home or wherever attractive furnishings are desirable.

It is the purpose of this invention to provide a reclinable back chair structure in which the chair frame does not tilt and all recline is achieved by movement of the back and seat frames. This enables the structure to be used, for example, in a Queen Anne wing back style chair supported on four exposed legs, yet having a back that reclines in response to back pressure applied by an occupant of the chair.

In a preferred embodiment, the chair has a seat frame that is suspended at its rear by swing links which are pivoted to the chair frame on a horizontal axis located above the level of the seat frame. The chair has a back frame which is mounted on the swing links and pivots with them about the horizontal axis. The position of the horizontal axis is selected to enable the back frame to be reclined to a larger angle with respect to the seat frame than is usually employed in chairs manufactured by the assignee of this invention. The front of the seat frame is supported by swing links which extend downwardly to pivot on the chair frame and define a front horizontal pivot axis for the seat frame which is located below it. Counterbalance springs are connected between them and the chair frame to provide resistance to recline of the back frame and assistance in its return to an upright position. They also help enable the back frame to be positioned as desired between full recline and upright positions. A novel linkage between the end of each spring and the adjacent swing link controls extension of the spring to keep it always tight and to apply the most advantageous degree of spring force. Resistance, which can be manually adjusted to suit the chair user, is provided in the linkage system to enable the freedom of movement between recline and upright positions of the back to be regulated.

DESCRIPTION OF THE DRAWINGS

FIG. 3 is vertical elevation of things shown in FIG. 2.

DETAILED DESCRIPTION OF THE INVENTION

Figure 1:
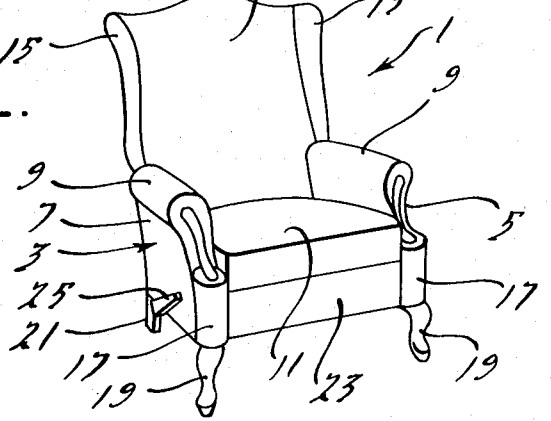
FIG. 1 is a perspective view of an upholstered Queen Anne style chair having a reclinable wing type back and movable seat and embodying the invention.
Figure 2:
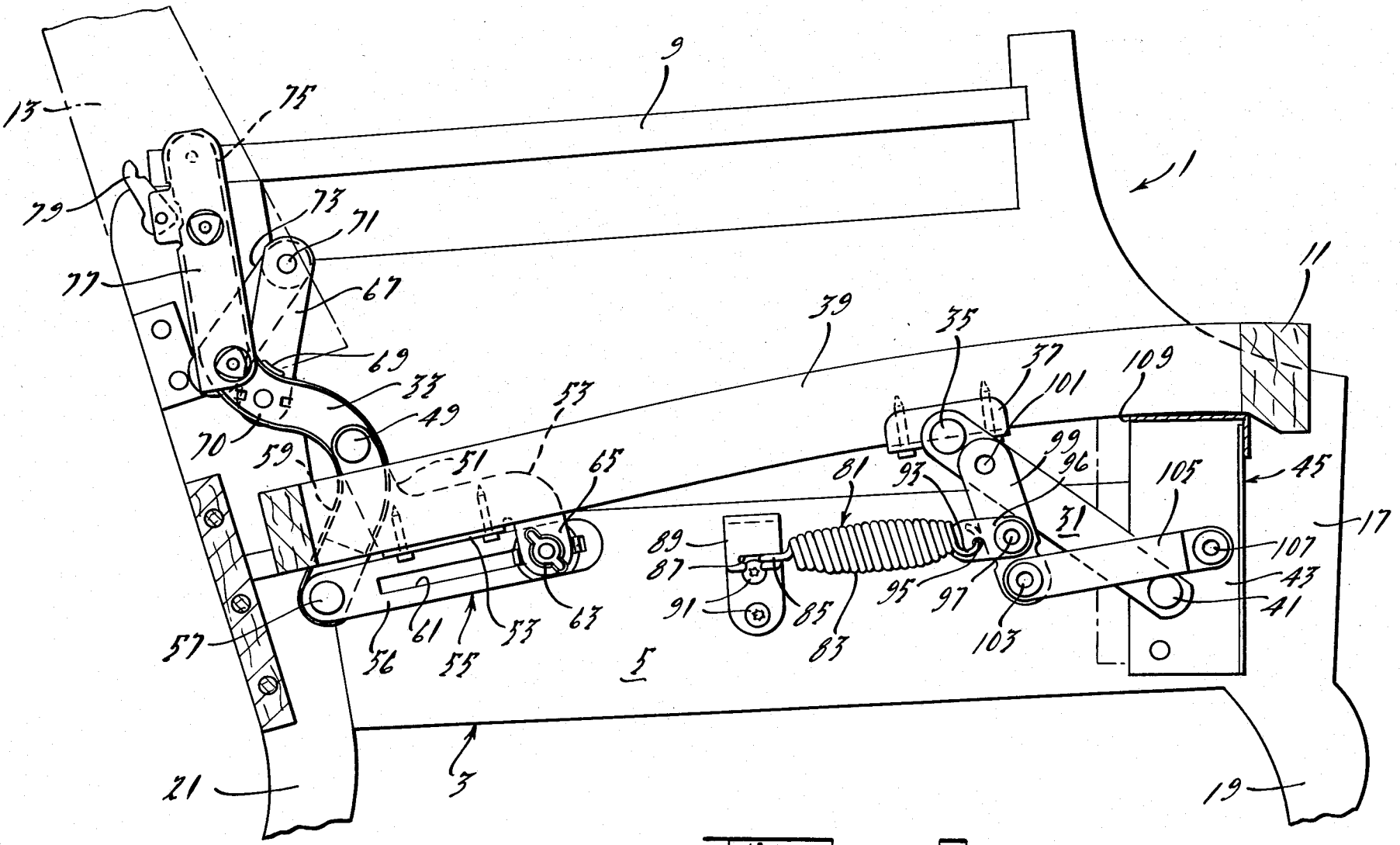

As seen in FIG. 1, the chair 1 has a chair frame 3 with upright left and right hand side members 5 and 7 that also define the chair arms 9. A horizontally extending seat frame 11 is located between side members 5 and 7 as is a vertically extending back frame 13, the back frame however, having integral wings 15 that overlie the side members 5 and 7 at the rear ends of the arms 9. The frame 3 includes front corner posts 17 and attached to the bottoms of them are a pair of Queen Anne style legs 19, the rear of the chair frame having a pair of legs 21. Though not shown or described hereinafter, there is a leg rest frame 23 nestled between posts 17 and manually operated by a side handle 25 to move to extended positions in front of the chair in a manner similar to that shown in other U.S. patents of the assignee, such as U.S. Pat. Nos. 3,096,121 (issued July 2, 1963), 3,099,487 (issued July 30, 1963), 3,235,307 (issued Feb. 15, 1966), 3,325,210 (issued June 13, 1967), and 4,367,895 (issued Jan. 11, 1983). The various frames referred to and the posts 17 are, of course, illustrated in upholstered condition in FIG. 1.

Figure 4:
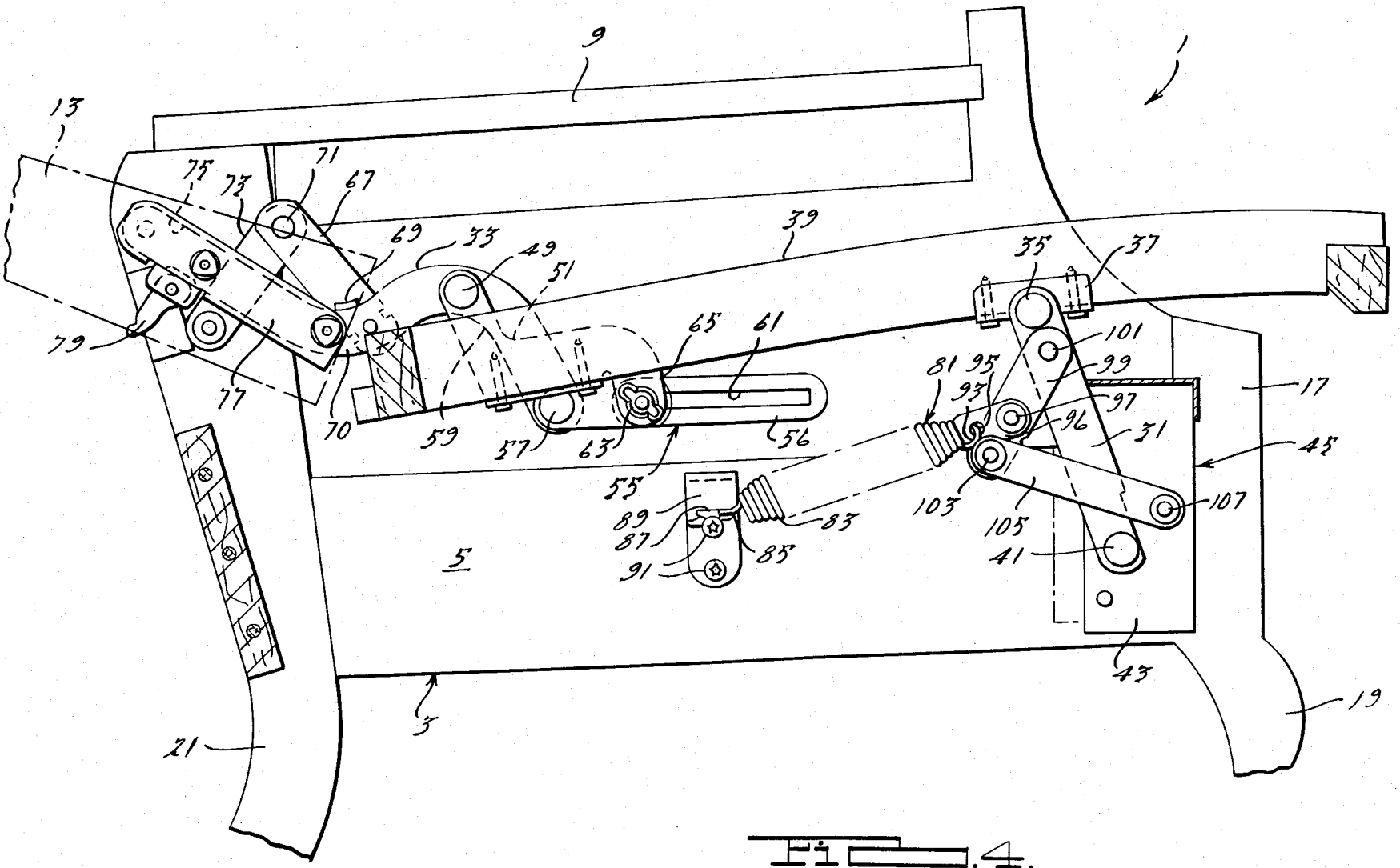
FIG. 4 is a cross-sectional view similar to FIG. 2 illustrating the chair in a reclined position.

In use, if a chair occupant leans back to apply pressure against back frame 13 in its upright position of FIG. 1, it will pivot rearwardly, i.e., recline, and at the same time the seat frame 11 will move forwardly and upwardly as shown in FIG. 4. If the occupant continues to apply sufficient pressure, the frame 13 will continue to pivot until it reaches a fully reclined position in which it is practically horizontal. If, then, the occupant lifts himself to remove the pressure of his back from the back frame 13, it will automatically return to the upright position due to the effects of his weight and a counterbalance spring means to be presently described.

Figure 2:
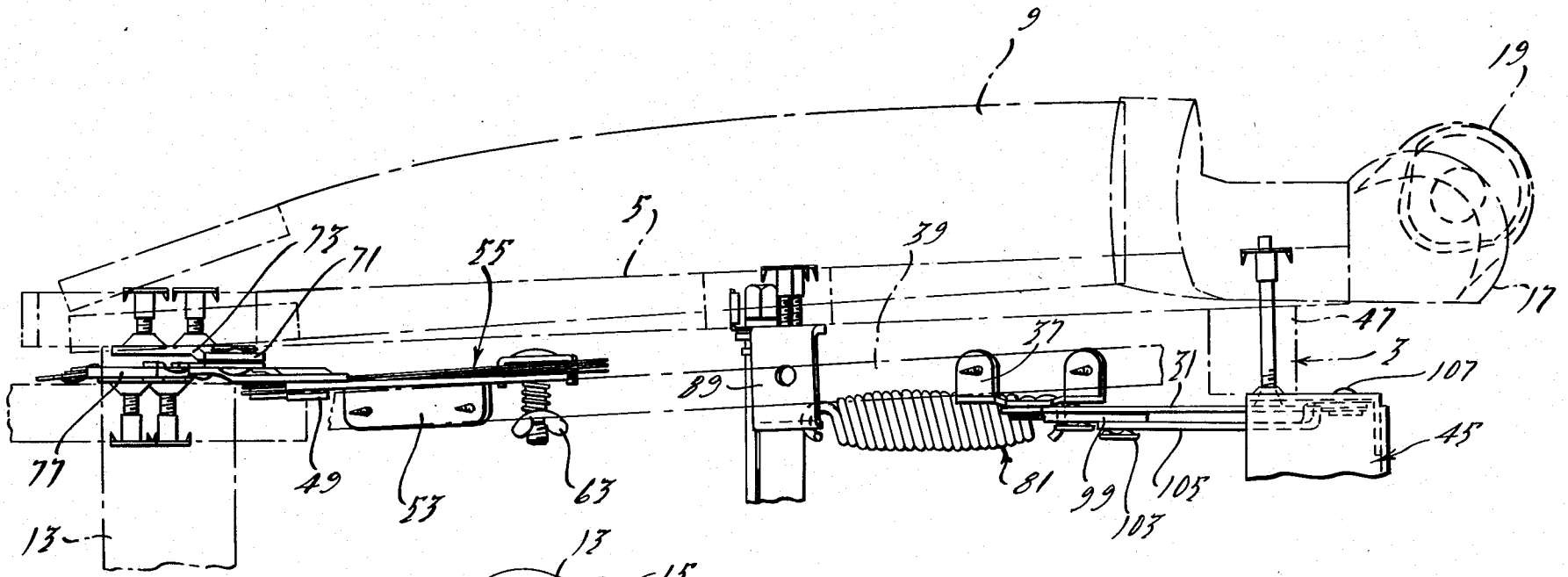
FIG. 2 is a vertical cross section, with upholstery and various parts removed, sectioned, broken away, or shown in phantom, taken adjacent and looking toward the left side of the chair, it being understood that the left and right sides of the chair are preferably substantially symmetrical insofar as the present invention is concerned so that only one needs to be illustrated and described.

Referring to FIGS. 2 and 3, the left hand side of seat frame 11 is shown as movably supported on chair frame 3 by a left hand front swing link 31 and a left hand rear swing link 33. There is corresponding structure (not shown) at the right hand side of the seat frame and, as already mentioned, the right hand structure, being substantially the same as that to be described for the left side of the chair, is not shown or described herein.

The front swing link 31 is a substantially straight member which is pivoted at its rear and top end at 35 to a bracket 37 that is affixed to a left side rail 39 of the seat frame 11. The front and lower end of the link is pivoted at 41 to a vertical wall 43 of a generally U-shaped sheet metal front cross beam 45 that extends between opposite side members 5 and 7 of the chair frame and is rigidly attached at its opposite ends to them, as by way of block 47 to which it is shown bolted in FIG. 3, to form a part of the rigid chair frame 3. Load on the front of the seat frame 11 is transmitted by link 31 into beam 45 and thus chair frame 3.

The rear swing link 33 is a curved element and is pivoted in a lower portion at 49 to an upstanding ear 51 on a bracket 53 that is affixed to the rear of the seat frame rail 39. The weight at the rear of the seat frame is therefore supported from pivot 49 by the link 33. Freedom of pivotal movement about pivot 49 may be preselected and manually regulated by means of an adjustable friction resistance means 55. This device as well as the general configuration of link 33 are shown in more detail in the aforementioned U.S. Pat. Nos. 4,367,895 and 4,235,307. Other U.S. patents of the present assignee showing in general the rear swing link and/or the resistance means 55 is the aforementioned U.S. Pat. No. 3,096,121 and also U.S. Pat. Nos. 3,357,739 (issued Dec. 12, 1967), 4,153,292 (issued May 8, 1979), 4,154,475 (issued May 15, 1979), and 4,179,157 (issued Dec. 18, 1979). The device 55 is a multiple layer slide friction link means 56 having a pivot connection 57 at its rear end to the backwardly curved bottom portion 59 of the rear swing link 33. The link means 56 has a slot 61 through its multiple layers which receives a hand-adjusted spring pressed assembly 63 or wing screw, nut, and washer which is mounted on a downwardly extending ear 65 of the bracket 53. By turning the wing nut, a chair user can control the friction in device 55 and the resistance to movement of the seat frame 11 relative to the swing link 33 at pivot 49. There are, of course, both left and right hand (not shown) resistance means 55.

Load in the rear swing link 33 is transferred into the chair frame side member 5 by way of an upwardly and forwardly extending arm 67 that is rigidly affixed, as by a weld 69, to the inside of a curved part 70 of the swing link. The upper end of arm 67 is pivoted at 71 to the upper end of a slanted link-plate 73 that is rigidly fixed to the chair frame side member 5. Load on arm 67 is transmitted by pivot 71 into plate 73 and the chair frame 3.

Left and right hand pivot means 71 define a rear horizontal pivot axis that is located above the rear end of the seat frame 11 which is suspended from it in the general manner of a pendulum. Left and right hand pivot means 41 at the bottom of front swing links 31 support the front of the seat frame 11 for pivoal movement about a front horizontal axis which is below it.

The rear swing link 33 has a straight section 75 extending upwardly from the curved section 70 and slightly to the rear. As shown in several of the aforementioned patents and claimed in assignee's U.S. Pat. No. 3,525,549 (issued Aug. 25, 1970), a channel-shaped bracket 77 fixed to the outer face of the left-side edge of back frame 13 can slidably slide down on and receive the link section 75. With a similar bracket and link section on the right side of the chair, the back frame 13 with wings 15 can be removably mounted on the chair frame 3. A latch device 79 can be used to latch it in place.

The back frame 13 is pivotal with a rear swing links 33 about the rear horizontal axis defined by pivot 71. Since most of the back frame is located above this axis, back pressure of a chair occupant has great leverage due to the large moment arm. This is noticeable when compared with the chair in aforementioned U.S. Pat. No. 4,367,895, for example, where the pivot 85 is at the top end of swing link 83 in the patent which corresponds to present link 33. The high pivot 85 limits backward movement of the back frame, i.e., recline, in the patented construction but this is offset by the fact that the chair frame in the patent can tilt rearwardly on pivots 41.

In the present structure the chair frame 3 cannot pivot, tilt, or rock rearwardly, being in a fixed or stationary position as, for example, is the chair frame in assignee's aforementioned U.S. Pat. No. 3,357,739. Because it is stationary, the chair can be styled in special ways that would not be practicable if the chair frame tilted. The style of FIG. 1 illustrates this, where, for example, the appearance is substantially identical to that of a straight back, non-reclinable formal chair. However, by lowering the pivot 71, as compared with pivot 85 in U.S. Pat. No. 4,367,895, the invention recaptures in added back frame pivoting or recline what is lost by making the chair frame non-tiltable. Such a change, however, changes the leverage relationships and the balance of the chair. To reconcile the different leverage conditions, the invention provides a counterbalance spring means 81 (on both left and right hand sides of the chair) which furnishes resistance to recline movement, tending to offset the increased moment arm, and which also provides assistance on return to upright, tending to offset loss in moment arm of the weight of the seat frame 11 and chair occupant. This acts on the seat frame forwardly of the rear horizontal axis provided by pivots 71 and tends to pivot the seat and back frames back to the upright position.

Lowering of the rear seat suspension pivot 71 also disturbed the relationship of relative movement of the back and seat frames. In order to control this so that the travel of the seat frame 11 follows a desirable path, the pivot 71 is moved forwardly off straight section 75, this being facilitated by use of arm 67. Also a change is made at the front swing links 31. In this way raising of the rear end of seat frame 11 and its fore and aft movement is controlled in a desired manner.

The counterbalance spring means 81 comprises a coil tension spring 83, preferably (though not clearly shown in the drawings) having substantially uniform diameter coils along most of its length but with necked down ends that have gradually reducing coil diameter for optimum multiple deflection strength. The longitudinal axis of the spring 83 is substantially horizontal and normal to the front and rear planes of the chair, i.e. substantially parallel to the longitudinal centerline (not shown) of the chair. The anchor hook 85 at the rear end is inserted in slot 87 in an inverted J-shaped spring mounting bracket 89 that is affixed, as by screws 91, to the left side member 5 of the chair frame 3. The anchor hook 93 at the front end of the spring 83 is hooked through a hole 95 in the rear end of a generally horizontal spring connector link 96 which has a front end pivoted at 97 to a downwardly extending spring control link 99, Pivot 97 is below the midpoint of link 99 which is pivoted at its upper end at 101 to an uppermost part of front swing link 31. The bottom of control link 99 is pivoted at 103 to the rear of a generally horizontally extending control link 105, its front end being pivoted at 107 to the wall 43 of chair frame cross piece 45. Slot 87 and hole 93 are spaced far enough apart so that once the hook ends of the spring 83 are extended through them, it will not be possible for it to fall off either the bracket 89 or the connector 96.

In operation of the counterbalance spring means 81, when the back frame 13 is pushed back, the seat frame 11 will move forwardly. This will pivot link 31 forwardly about its pivot 41 and that will carry pivot 101 in an arc about pivot 41. Movement of pivot 101 will carry with it the top of spring control link 99 which will also move in an arc centered on pivot 41. The bottom of link 99 will, however, move in an arc having a center at pivot 107, which is a little higher and to the front of pivot 41, and a radius corresponding to the length of link 105 between pivots 103 and 107. The orientation of link 99 is therefore determined by links 31 and 105; and this orientation determines the position of pivot 97. This pivot allows the link 96 to always be coaxial with the spring 83, that is it permits the spring 83 to self-align and minimize spring noise.

The front swing link 31 can pivot from the back upright position of FIG. 2 until it is close to the rear edge 109 of cross brace 45, which is the full back recline position of the chair, (such position being determined by slot 61). In the upright position of FIG. 2, the spring 83 is either unstressed or virtually unstressed but as the control link 99 rotates with link 31 it is stretched and stores energy. The amount of extension of the spring and the extent of its swinging movement about rear bracket 89 are under the control of the two links 99 and 105. Since the chair 1 may be reclined many thousands of times in its useful life, fatigue failure of the spring 83 is a factor for consideration. The necked down ends, previously mentioned, improve fatigue resistance. Additionally, the spring extension control linkage reduces the amount of extension of the spring as compared to what would take place if the front end 93 was anchored directly on the seat frame 11. As thus controlled, the spring extension is selected to be substantially less than the spring manufacturer's recommendation for maximum deflection and low enough to avoid fatigue failure of the spring during repeated back recline. Thus, the links 99 and 105 give an optimum force pattern on the spring 83 but keep it tight. They also minimize swinging about rear bracket 89 and reduce the amount of space needed to accommodate the spring, which is important because there is only limited space available for it. Thus, advantages of the present arrangement over a prior arrangement in U.S. Pat. No. 3,235,307 (issued Feb. 15, 1966) can be seen. In addition the spring 83 is attached at the highest point to link 31, that is at pivot 101, thereby getting maximum leverage. When back pressure on back frame 13 is released, the tension stored in spring 83 (on both sides of the seat frame) will pull the link 31 toward the rear of the chair thereby moving seat frame 11 toward the rear end applying force to help the weight acting on seat frame 11 to return the back frame 13 toward its upright position illustrated in the drawings.

Modifications may be made in the specific details shown and described without departing from the spirit and scope of the invention. As a further observation, it may be noted that the various frames, e.g., chair frame, seat frame, and back frame are normally made of wood and have suitable springs and upholstery attached to them. The various links, on the other hand, will normally be made of steel.

I claim:

1. A chair comprising a substantially rigid chair frame, means supporting the chair frame in a normally upright position on and relative to the floor, said chair frame including vertically extending left and right hand side members, a horizontally extending seat frame located between the side members, a normally vertically extending back frame at the rear of the chair frame and extending upwardly above the seat and chair frame, left and right hand rear swing links, first pivot means pivoting said rear swing links to said left and right hand side members respectively of said chair frame for pivoting about a rear horizontal axis located above said seat frame, second pivot means pivoting lower portions of said rear swing links to the left and right hand sides respectively of the seat frame at the rear thereof whereby the rear of said seat frame is supported and suspended by said rear swing links for pivotal movement about said horizontal axis, weight of the seat frame and of a chair occupant when not leaning against the back frame being centered forwardly of said rear horizontal axis and providing a moment tending to pivot the swing links on the first pivot means so that the second pivot means moves toward the rear of the chair, left and right hand front swing links pivoted respectively to left and right hand sides of said seat frame at the front thereof, said front swing links extending downwardly from the seat frame and being pivoted to said chair frame for pivoting about a front horizontal axis located below the seat frame, said seat frame being movable forwardly and upwardly on said front and rear swing links, means securing the back frame to said rear swing links above said rear horizontal axis and so that back pressure of a chair occupant on said back frame pivots said rear swing links on said first pivot means to produce recline movement of the back frame and corresponding forward and upward movement of the seat frame, said back frame and rear swing links being movable together between a position wherein the back frame is upright and a position wherein it is fully reclined, left and right hand counterbalance coil tension springs connected between said chair frame and the respective front swing links to be energized by movement of the front swing links and to provide spring assistance to return movement of the back frame toward an upright position, and left and right hand spring connector link means operatively connecting respectively the front ends of said counterbalance springs to the left and right hand front swing links adjacent the tops thereof and serving to reduce the amount of extension of the springs as compared with that which would occur if the springs were anchored directly on the front swing links.

2. A chair as set forth in claim 1 wherein each said spring connector link means includes a downwardly extending control link pivoted at its upper end to said front swing link, said counterbalance spring being connected to a lower point on said control link.

3. A chair as set forth in claim 1 wherein each said spring connector link means includes a horizontally extending control link pivoted at its rear end to a lower part of said downwardly extending control link at its forward end to said chair frame.

4. A chair frame as set forth in claim 3 wherein each said spring connector link means includes a horizontally extending anchor link pivoted at its forward end to an intermediate part of said downwardly extending control link, the front end of said counterbalance spring being anchored on the rear end of said spring connector link.

5. A chair frame as set forth in claim 4 wherein each said counterbalance spring is a coil spring having substantially uniform diameter coils through most of its length, the front and rear end sections of said coil spring being gradually reduced in diameter toward the ends of the spring and the points at which the spring is anchored respectively to said bracket means and said spring connector link.

6. A chair frame as set forth in claim 5 including left and right hand adjustable resistance means located respectively adjacent the left and right hand second pivot means to impose an adjustable resistance to pivotal movement of the seat frame on the rear swing links.

7. A chair as set forth in claim 1 including adjustable resistance means connected to the seat frame to impose an adjustable resistance to movement of the seat frame and back frame.

8. A chair as set forth in claim 1 wherein said rear swing links have substantially straight upwardly extending portions, said back frame being removably mounted on said straight portions, said rear swing links having rigid arm portions extending forwardly of said straight portions and the forward ends thereof being pivoted by said first pivot means to said chair frame.

9. A chair as set forth in claim 8 wherein said front swing links are substantially straight.

* * * * *